US009011191B2

(12) United States Patent
Connor

(10) Patent No.: US 9,011,191 B2
(45) Date of Patent: Apr. 21, 2015

(54) MULTI-DIRECTIONAL SURFBOARD AND METHOD

(71) Applicant: Derek Connor, Newton, NJ (US)

(72) Inventor: Derek Connor, Newton, NJ (US)

( * ) Notice: Subject to any disclaimer, the term of this patent is extended or adjusted under 35 U.S.C. 154(b) by 0 days.

(21) Appl. No.: 14/533,299

(22) Filed: Nov. 5, 2014

(65) Prior Publication Data

US 2015/0050851 A1 Feb. 19, 2015

(51) Int. Cl.
*B63B 35/00* (2006.01)
*B63B 35/79* (2006.01)

(52) U.S. Cl.
CPC ..... *B63B 35/7923* (2013.01); *B63B 35/7906* (2013.01)

(58) Field of Classification Search
USPC ..... 441/74, 79; 114/274
IPC ..... B63B 35/7926,35/7906
See application file for complete search history.

(56) References Cited

U.S. PATENT DOCUMENTS

| | | | | | |
|---|---|---|---|---|---|
| 3,455,261 | A | * | 7/1969 | Perrin | 114/39.15 |
| 3,747,138 | A | | 7/1973 | Morgan | |
| 3,761,980 | A | * | 10/1973 | Silverstein | 441/68 |
| 4,320,546 | A | | 3/1982 | Knox | |
| 4,886,476 | A | * | 12/1989 | Brocone et al. | 441/65 |
| 4,894,035 | A | * | 1/1990 | Pia | 441/79 |
| 5,062,378 | A | * | 11/1991 | Bateman | 114/274 |
| 5,106,331 | A | * | 4/1992 | Lizarazu | 441/55 |
| 5,152,705 | A | * | 10/1992 | Rock | 441/74 |
| 5,887,538 | A | * | 3/1999 | Cruz | 114/39.22 |
| 6,007,393 | A | * | 12/1999 | Choiniere et al. | 441/74 |
| 6,149,479 | A | * | 11/2000 | Redmon et al. | 441/79 |
| 6,461,210 | B2 | * | 10/2002 | Lorenzo | 441/68 |
| 7,244,157 | B2 | | 7/2007 | Simpson | |
| 7,717,763 | B2 | * | 5/2010 | Lei | 441/74 |
| 2008/0248702 | A1 | * | 10/2008 | Wilkie | 441/79 |
| 2013/0102210 | A1 | * | 4/2013 | Wilbur | 441/74 |

OTHER PUBLICATIONS

Hydrofoil surfboard (1990s): http://surfing.about.com/od/thesurfboard/a/What-Is-A-Foilboard-Or-Hydrofoil-Surfboard.htm, printed: Oct. 30, 2014.

* cited by examiner

*Primary Examiner* — Stephen Avila
(74) *Attorney, Agent, or Firm* — Walter J. Tencza, Jr.

(57) ABSTRACT

A board including a contact section, and a first step section which is at a different height from the contact section so that it does not make contact with a substantially level water surface when the board is at rest on the top of the substantially level water surface. The board further including a first hydrofoil fixed to the first step section. The first hydrofoil includes a keel and the first hydrofoil is fixed the first step section so that the keel is substantially perpendicular to the board. The first hydrofoil includes a wing which is fixed to and substantially perpendicular to the keel of the first hydrofoil. The wing is angled relative to the first step section from zero degrees to ninety degrees. The board may include a second step section and a second hydrofoil, which may be fixed to the second step section.

18 Claims, 18 Drawing Sheets

MULTI-DIRECTIONAL SURFBOARD AND METHOD

FIELD OF THE INVENTION

This invention relates to improved methods and apparatus concerning surfboards and other water sport boards.

BACKGROUND OF THE INVENTION

Surfing began as an ancient art practiced by cultures native to islands in the Pacific Ocean. During those times, a surfboard was no more than a large, heavy piece of wood which was shaped down into a very simplistic, flat plane. In the 1930s a boat keel was attached to the bottom of a surfboard near the tail end which opened the door to fins. Since then, surfboards have become smaller, lighter, and use various amounts of fins which are now more sleek and practical with regard to hydrodynamics. Many of the construction materials have changed; however, the conceptual configuration has basically remained the same throughout history. The traditional apparatus of a surfboard has a top deck, a bottom, a nose, a tail, two rails and a set of fins attached to the bottom near the tail end. This apparatus creates the condition that the board will only properly ride a wave when the nose is facing forward and the tail is trailing behind. The directional limitations of this traditional apparatus also limit the performance capabilities of a surfer. For example, a surfer may be riding along a wave in a general direction, become airborne by leaving the surface of the wave with the board, spin in the air with the board, and land on the wave with the board facing backwards while still moving in the original general direction. Since the traditional surfboard apparatus is designed to properly function with the nose facing forward and the tail trailing behind with the fins, the surfer will be able to ride the backwards facing board for a brief period of time and with minimal control before having to spin the board back around so it is again facing in the proper direction in order to continue riding the wave. While the maneuvers which are being preformed by surfers continue to progress, the configuration of the traditional surfboard apparatus limits the possibilities of this progression. There is a need for a surfboard that can be practically and equally controlled from either end and that practically allows three hundred sixty degrees of directional capabilities parallel to the surface of the water.

SUMMARY OF THE INVENTION

In at least one embodiment of the present application a multi-directional surfboard is provided which is configured to be effectively and practically controlled from either end using a raised hydrofoil configuration. The raised hydrofoil configuration includes a contact section, one or more step sections, and one or more dive foils. One or more embodiments of the present invention provide directional capabilities equivalent to that of a snowboard or skateboard (i.e. the abilities to slide sideways and spin three hundred and sixty degrees).

In at least one embodiment, a multi-directional surfboard is provided which is used to catch and ride waves in the traditional sense of a surfboard. During the process of riding a wave, an individual will center his/her weight over a typically central contact section in order to hydroplane across the surface of a body of water. To engage dive foils, the individual will apply downward pressure to a step section, effectively submersing one or more dive foils beneath the surface of the water. The one or more dive foils will generate a downward lift and pull the step section towards the surface of the water. When engaged, the one or more dive foils will be used to control the surfboard in the same manner as a traditional fin system. Maneuvers such as spinning and sliding can be executed when weight is distributed properly throughout the length of the board.

One of the advantages of an apparatus in accordance with one or more embodiments of the present invention is that an individual has a full three hundred sixty degree range of directional capabilities parallel to the surface of the water while being able to maintain full control from either end, and is no longer limited to the restricted directional capabilities of a traditional surfboard with a traditional fin system.

DETAILED DESCRIPTION OF THE DRAWINGS

Figure 1A:
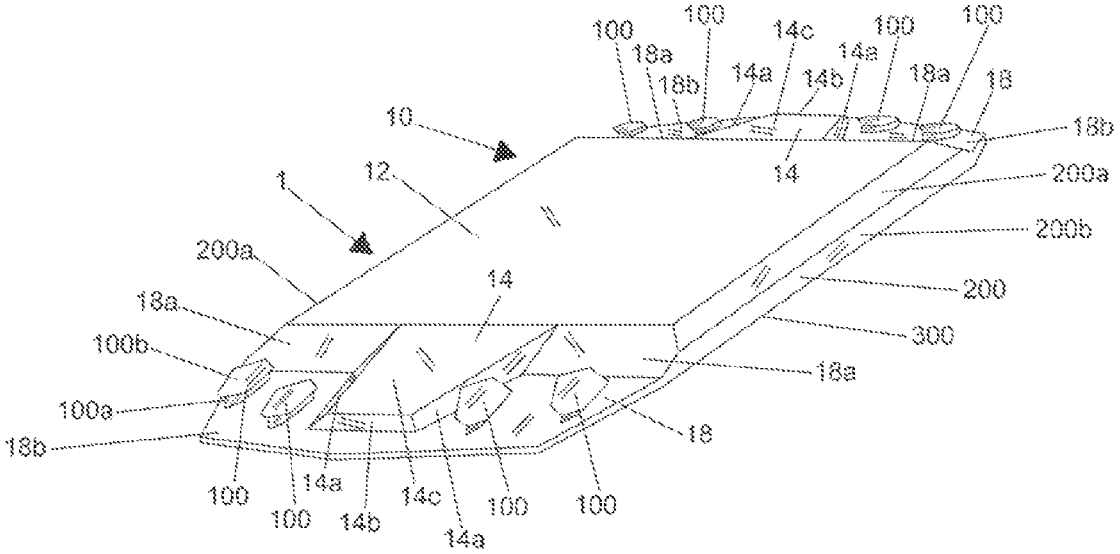
FIG. 1A shows a bottom, end, and side perspective view of an apparatus 1 including a board and a plurality of attached dive foils in accordance with an embodiment of the present invention.
Figure 1B:
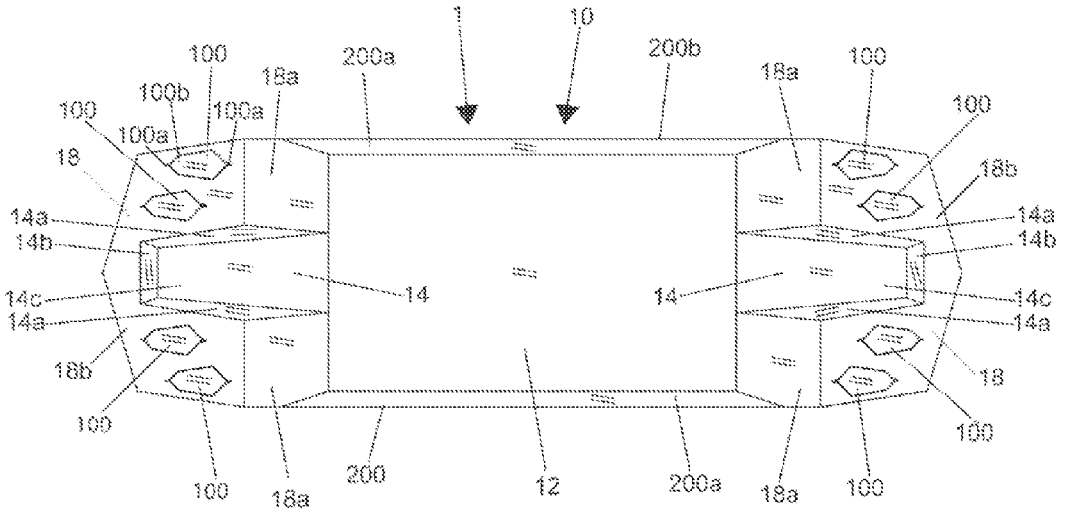
FIG. 1B shows a bottom view of the apparatus of FIG. 1A
Figure 1C:
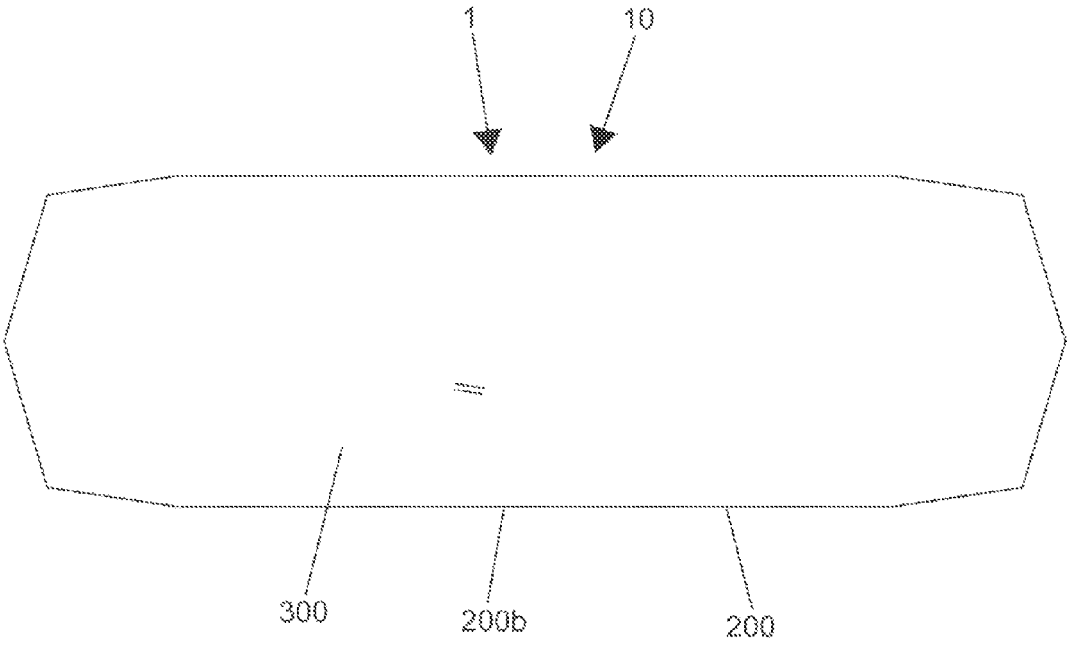
FIG. 1C shows a top view of the apparatus of FIG. 1A
Figure 1D:
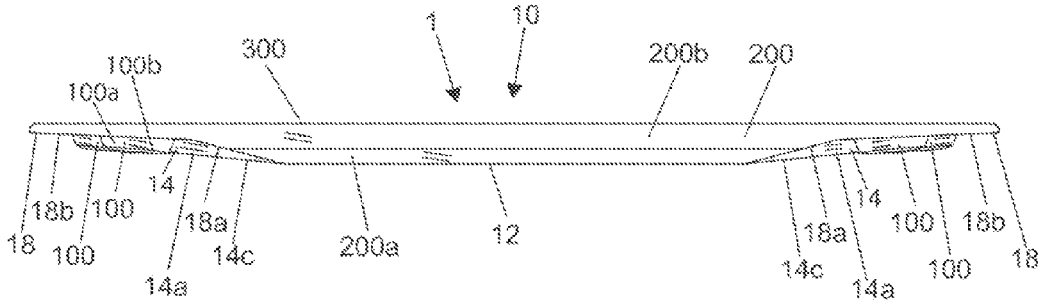
FIG. 1D shows a side view of the apparatus of FIG. 1A

FIG. 1A shows a bottom, end, and side perspective view of an apparatus 1 including a board 10 and a plurality of dive foils, each of which may be identical and each of which is identified as 100, wherein each dive foil, identified as 100 is attached to the board 10 in accordance with an embodiment of the present invention. FIG. 1B shows a bottom view of the apparatus 1. FIG. 1C shows a top view of the apparatus 1. FIG. 1D shows a bottom view of the apparatus 1. The board 10, shown in FIG. 1A, may be constructed of any materials that previously known surfboards are constructed of. Each dive foil 100 of the plurality of dive foils, shown in FIG. 1A, may be constructed of any suitable materials. While the board 10 and each dive foil 100 may be made of materials and from techniques that were previously known, the actual structure and/or configuration of the board 10 and each dive foil 100, and specific ways of making or constructing the board 10 and each dive foil 100 may differ from previously known surfboards.

Referring to FIG. 1A, FIG. 1B, and FIG. 1D, the board 10 includes a contact section 12, two contact extensions, which may be identical to each other, and each of which is identified as contact extension 14, two step sections, which may be identical to each other, and each of which is identified as step section 18, and two portions, which may be identical to each other and each of which is identified as portion 200 and each of which includes a rail 200*a* and an edge 200*b* of the board 10. The board 10 includes the deck 300 which may be a flat surface as shown in FIG. 1C and FIG. 1D, and may also include slanted or sloped surfaces. The contact section 12 may have a flat surface as shown in FIG. 1A, and may also include slanted or sloped surfaces. Each of the contact extensions 14 may reside in the corresponding step section 18 as shown in FIG. 1A. Each of the contact extensions 14 may have surfaces that are slanted or sloped as shown in portions 14*a*-14*c* as shown in FIG. 1A. Each step section 18 has a surface 18*b* which may be slanted or sloped, and slanted or sloped surfaces 18*a* joining to the contact section 12 as shown in FIG. 1A. Surface 18*a* and surface 18*b* of each step section 18 may be changed to be one continuous slope. Surface 18*a* and the adjacent end of the contact section 12 may be changed to be one continuous slope. The contact section 12 of the board 10 is located between the two step sections, each of which is identified as step section 18, as shown in FIG. 1A.

Figure 1E:
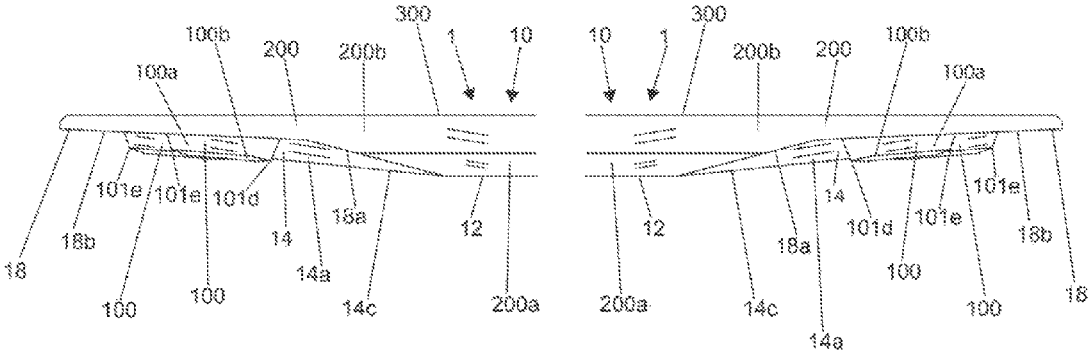
FIG. 1E shows a close up side view of both ends with the middle portion removed of the apparatus of FIG. 1A

FIG. 1E shows a close up side view of each end of the apparatus 1 with the middle portion removed. FIG. 1E shows the surface piercing end 101*d* and the trailing end 101*e* of each dive foil 100. FIG. 1E shows that each dive foil 100 on the left side face in the opposite direction of each dive foil 100 on the right side. As shown in FIG. 1E, each dive foil 100 on the left side face in the opposite direction of each dive foil 100 on the right side so that the apparatus can be controlled from either end in an identical manner.

Figure 1F:
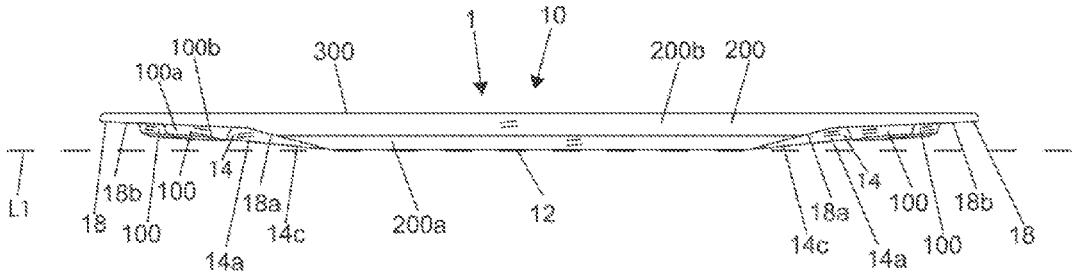
FIG. 1F shows a side view of the apparatus of FIG. 1A, with the apparatus of FIG. 1A, in a first state, parallel to a dashed line L1, which represents a water line or level.

Each dive foil 100 is a hydrofoil which is mounted to the bottom of the board 10 to portion 18*b* of a step section 18 as shown in FIG. 1A. In operation, the apparatus 1 is placed on a body of water having a top surface represented by line L1 in FIG. 1F, such that the contact section 12 of the board 10 is on the top surface L1 of the body of water as shown in FIG. 1F. In the state of FIG. 1F, all of the dive foils, each of which is identified as 100, reside above the contact section 12, and do not make effective contact with the top surface of the water, represented by line L1 as shown in FIG. 1F. The two step sections 18 allows the appropriate dive foils of the plurality of dive foils, each identified as dive foil 100 to not make effective contact with the top surface L1 of the water in the state as shown in FIG. 1F. One major purpose of the contact extension 14, in at least one embodiment, is to keep the dive foils 100 from making unnecessary/unwanted contact with the surface of the water L1 in the state shown in FIG. 1F.

Figure 1G:
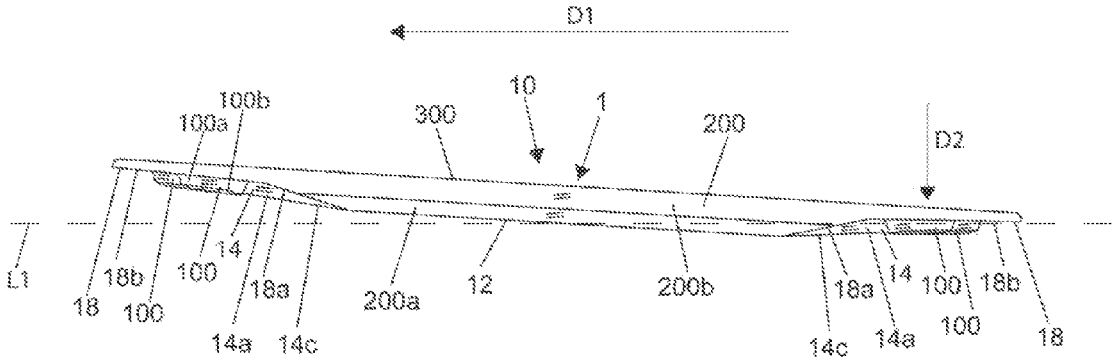
FIG. 1G shows a side view of the apparatus of FIG. 1A, with the apparatus of FIG. 1A, in a second state, not parallel to a dashed line L1, which represents a water line or level.

In the diagram of FIG. 1G, the apparatus 1 is moving in the direction D1. In the diagram of FIG. 1G, a person applies pressure in the direction D2 to the top of the top surface of the deck 300 of the board 10 directly above one step section 18 engaging one or more dive foils 100 within the corresponding step section 18. Referring to FIG. 1G, as an example, a person may push down with a foot on the section 18 to the right, while not applying any pressure to the opposite step section 18 to the left; and this causes the apparatus 1 to pivot from the position or state of FIG. 1F to the position or state of FIG. 1G. When one or more of the dive foils 100 are engaged, such as the dive foils 100 on the right side in FIG. 1G, the appropriate dive foils 100 penetrate the surface of the water L1 as shown in FIG. 1G. Each wing 100*b* of each dive foil 100 and each keel 100*a* of each dive foil 100 are shaped to move smoothly through the water while exerting minimal drag force.

The end of the apparatus 1 which will be engaged is dependent on the direction in which the board 10 is traveling because a skilled rider would know to engage the trailing end of the apparatus 1, i.e. the end of the apparatus 1 that trails as the apparatus 1 moves through the water propelled for example by a wave, as that is the end from which the board 10 is to be controlled. For example, in FIG. 1G, the board 10 is moving in the direction D1 from right to left which means that the right end of the board 10 is the end which will be engaged. A skilled rider would know that the left end would not be engaged while moving in the direction D1 as shown in FIG. 1G because this would result in the entire left end or leading end of the apparatus 1 to dive below the surface of the water and eject the rider forward off of the board 10. Each dive foil 100, which is attached to the left end of the board 10, as shown in FIG. 1G, is not going to be engaged, meaning engaged in the water, in the state as shown in FIG. 1G. Rather, it is each dive foil 100, which is attached to the right end of the board 10 as shown in FIG. 1G, which will be engaged in the water, and typically will have the greatest if not the majority of the effect on the movement of the apparatus 1. Due to the fact that the board 10 can be controlled from either end, this means that the leading end of each dive foil 100 faces towards the center of the board 10 while the trailing end of each dive foil 100 faces away from the center of the board 10 as shown in FIG. 1E.

Figure 1H:
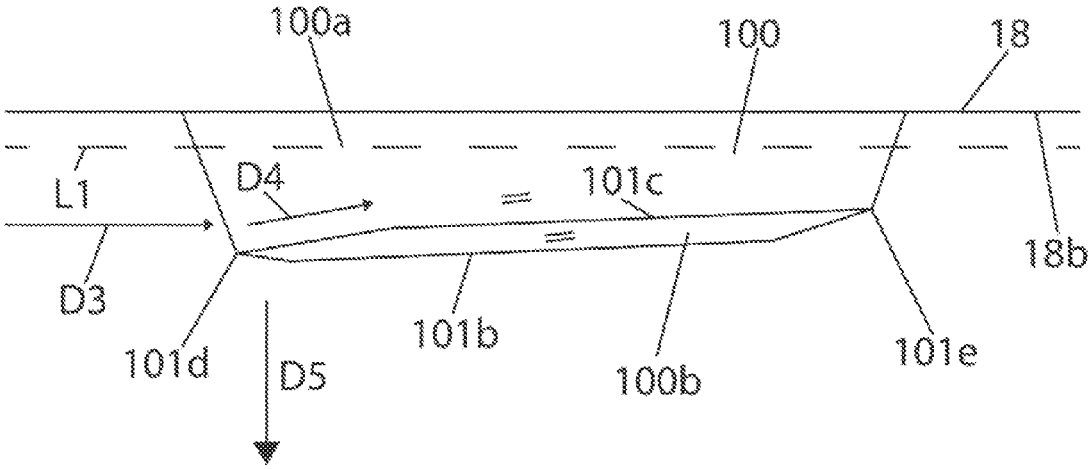
FIG. 1H shows a close up view of a dive foil of the apparatus of FIG. 1A, with the apparatus 1 of FIG. 1A in the second state, shown in FIG. 1F.

FIG. 1H shows a close up view of an engaged dive foil 100 on the right side of the apparatus 1 as shown in FIG. 1G. In reference to FIG. 1H, where each wing 100*b* has a first slope and a following slope on the top portion 101*c*, this can be changed to be one continuous slope. FIG. 1H also shows the surface piercing leading end 101*d* and the trailing end 101*e* of a wing 100*b* of a dive foil 100. When one or more of the dive foils 100 are engaged, a wing 100*b* of a particular dive foil 100 as shown in FIG. 1H, is shaped to move smoothly through the water and may cause the flow of water in the direction D3 to be deflected upward, in the direction D4 as shown in FIG. 1H, which according to Newton's Third Law of Motion exerts a downward force D5 on the particular engaged dive foil 100 as shown in the diagram of FIG. 1H. This redirection of the flow of water as shown in FIG. 1H, from the D3 direction to the D4 direction causes higher pressure on the top portion 101*c* of the wing 100*b* of the dive foil 100 and reduced pressure on the bottom portion 101*b* of the wing 100*b* of the dive foil 100. This pressure difference is accompanied by a velocity difference, via Bernoulli's principle, so the resulting flow field of water over the top portion 101*c* of the wing 100*b* of the dive foil 100, and underneath the step section 18, i.e. between 18 and 100*b* has a higher average velocity than the flow field of water below, i.e. below bottom 101*b* of a wing 100*b* of the dive foil 100. When engaged, such as for a dive foil 100 in FIG. 1H, one or more dive foils 100 are utilized to control the board 10 in the manner of a traditional fin system. The board 10 can be controlled in the manner referred to by FIG. 1G, from either end.

Figure 1I:
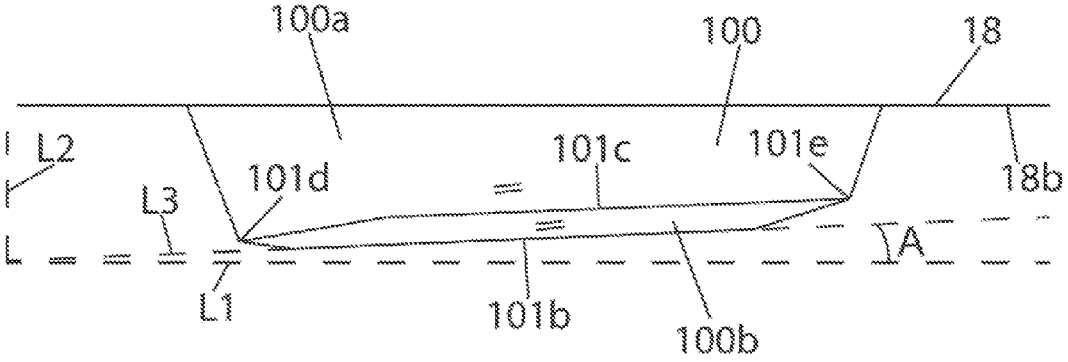
FIG. 1I shows a close up view of a dive foil of the apparatus of FIG. 1A, with angles of wings shown.
Figure 2A:
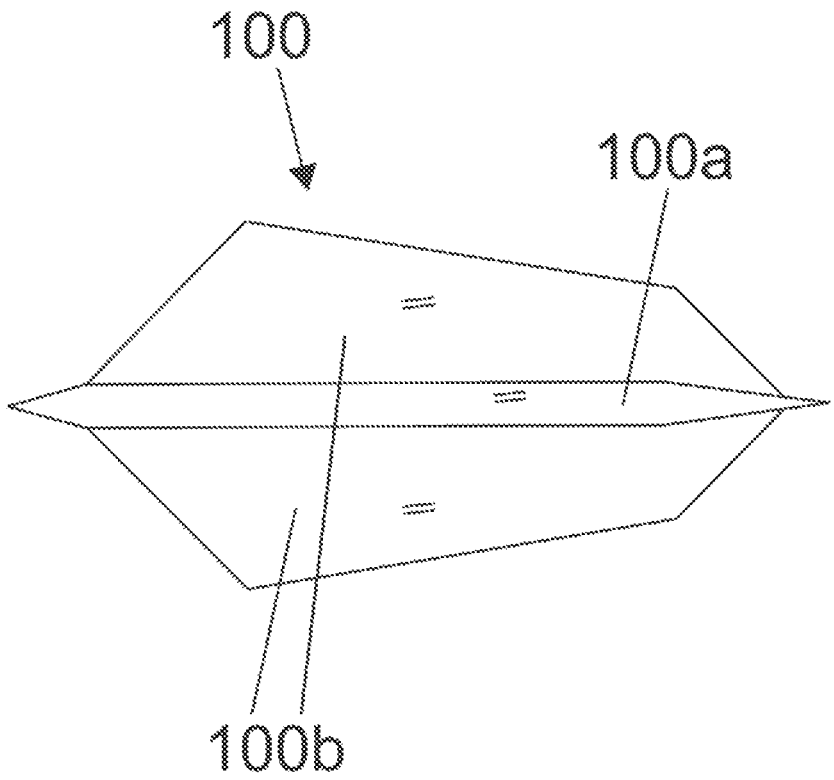
FIG. 2A shows a top view of the dive foil shown in FIG. 1G for use with the apparatus 1 of FIG. 1A.
Figure 2B:
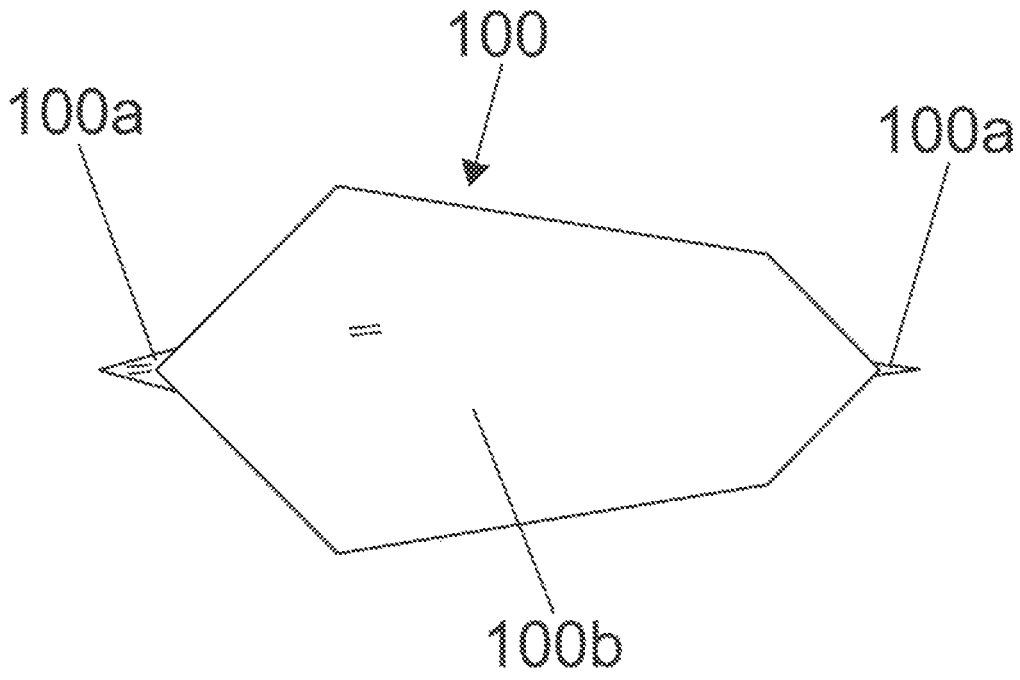
FIG. 2B shows a bottom view of the dive foil as shown in FIG. 1G.
Figure 2C:
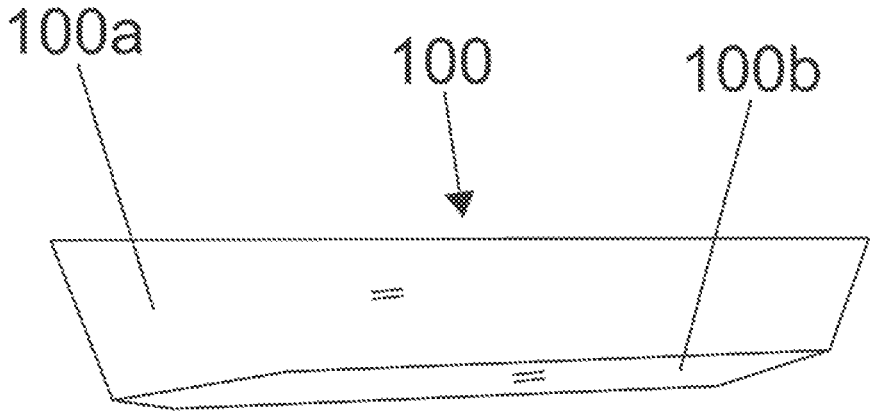
FIG. 2C shows a side view of the dive foil as shown in FIG. 1G.
Figure 2D:
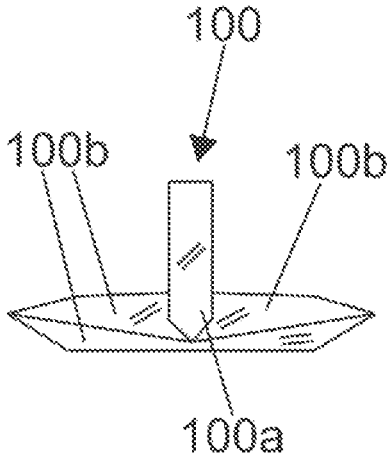
FIG. 2D shows a leading end view of the dive foil as shown in FIG. 1G.
Figure 2E:
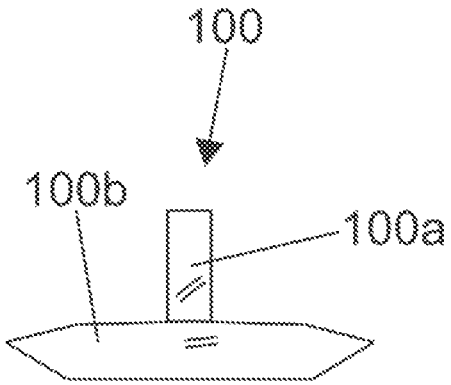
FIG. 2E shows a trailing end view of the dive foil as shown in FIG. 1G.

FIG. 1I shows the angle A of the wing 100*b* of a dive foil 100 as shown in FIG. 1H. A dashed line L1, which is parallel to the portion 18*b* of the step section 18, is shown in FIG. 1I. A dashed line L2 which is perpendicular to the portion 18*b* of the step section 18, is shown in FIG. 1I. A dashed line L3 which is parallel to a bottom portion 101*b* of a wing 100*b*, is also shown in FIG. 1I. The line L3, makes an angle A with the line L1. In at least one embodiment, it is preferred and critical that the apparatus 1 be configured so that the angle A is greater than or equal to zero degrees and less than ninety degrees, as shown in FIG. 1I. In reference to the diagram shown in FIG. 1I, at ninety degrees the bottom portion 101*b* of a wing 100*b* would be parallel to line L2 which is perpendicular to the portion 18*b* of the step section 18. In reference to the diagram shown in FIG. 1I, at zero degrees the bottom portion 101*b* of a wing 100*b* would be parallel to the line L1 which is parallel to the portion 18*b* of the step section 18. In at least one embodiment, it is preferred and critical that each dive foil 100 be configured so that the angle A of its wing or wings 100*b* with respect to the portion 18*b*, is greater than or equal to zero degrees and less than ninety degrees. The configuration shown in FIG. 1I, with the line L3, at an upwards and/or positive angle A with respect to line L1, and where angle A is less than or equal to ninety degrees, causes water flow proceeding in the direction D3 to be redirected upwards in the direction D4 as shown in FIG. 1H. As shown in FIG. 1I, the angle A is configured between the line L1 and the line L2 based on position of the trailing end 101*e* of a wing 100*b* of a dive foil 100, while the surface piercing end 101*d* of a wing 100*b* of a dive foil 100 remains stationary.

Referring to FIGS. 2A-2E, each dive foil 100 includes a keel 100*a* and two wings 100*b*.

Figure 3A:
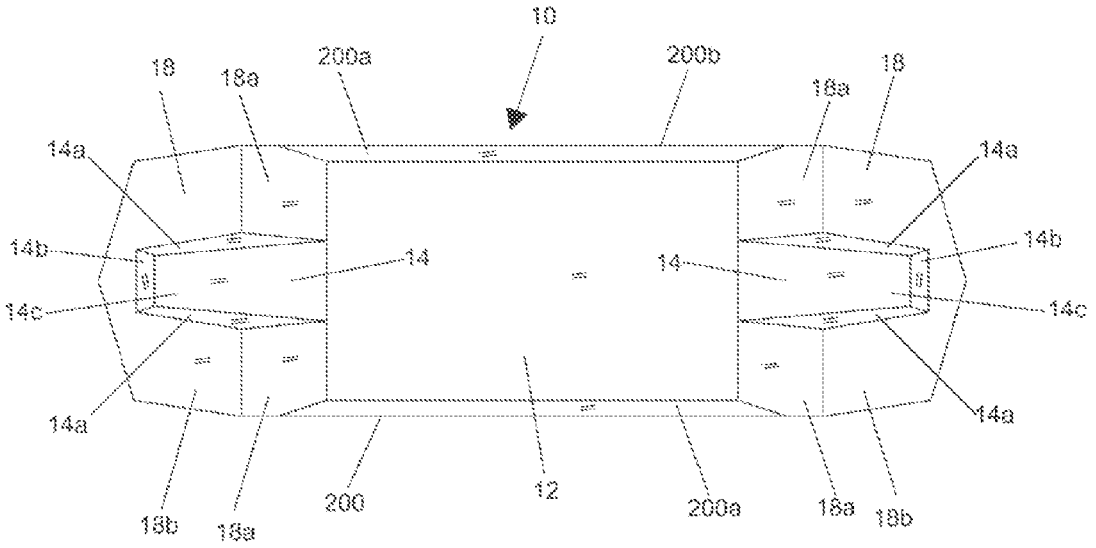
FIG. 3A shows a bottom view of the board for use with the apparatus of FIG. 1A.
Figure 3B:
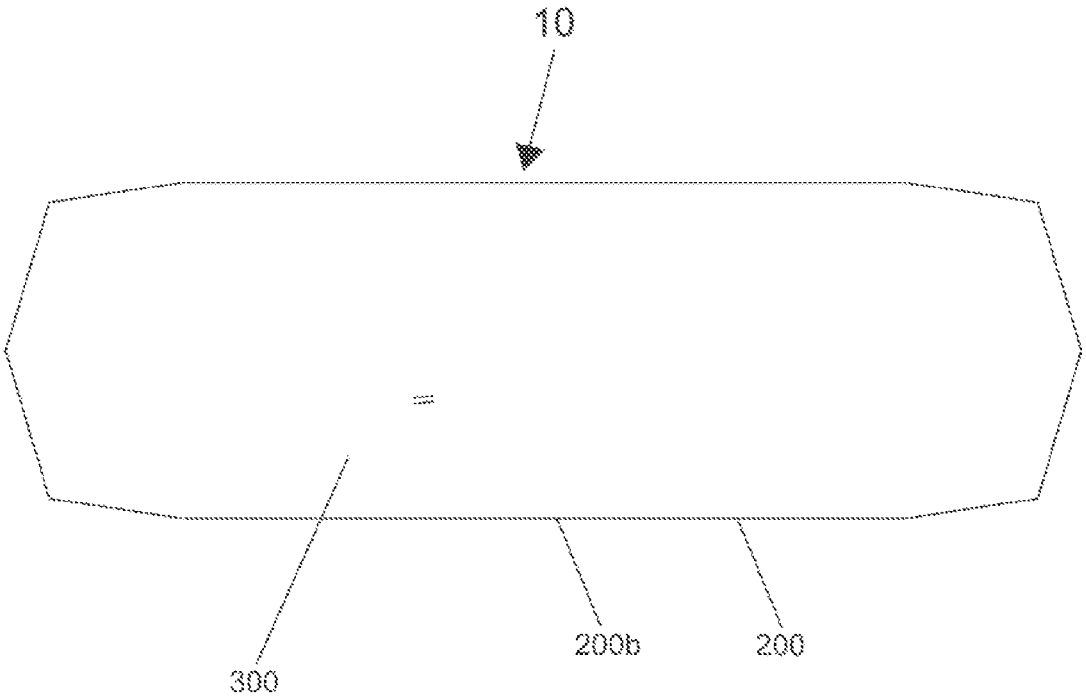
FIG. 3B shows a top view of the board of FIG. 3A.
Figure 3C:
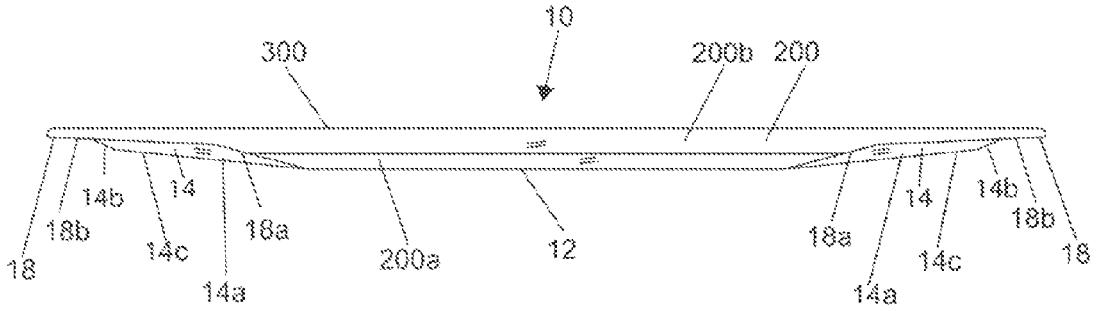
FIG. 3C shows a side view of the board of FIG. 3A.

FIG. 3A shows a bottom view of the board 10. FIG. 3B shows a top view of the board 10. FIG. 3C shows a side view of the board 10.

Figure 4:
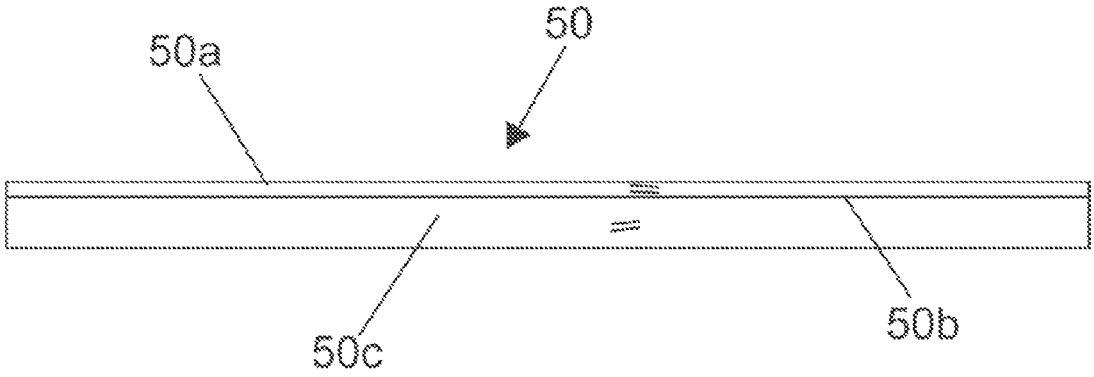
FIG. 4 shows a side view of an unshaped core for use in forming the board of FIG. 3A.

FIG. 4 shows a side view diagram of an unshaped core 50, which can be formed and/or shaped into the board 10 in FIG. 1A, with the core 50 having a horizontal stringer construction. The horizontal stringer construction of the core 50 may include layers 50*a*, 50*b*, and 50*c*, of materials in FIG. 4. For example, a top layer 50*a* may be made of foam, a middle layer 50*b* may be made of plywood and may be considered a stringer, and a bottom layer 50*c* may be made of foam, as shown in FIG. 4. The middle layer of 50*b* is shown as only a line and may be made of any suitable material. The bottom layer 50*c* and the top layer 50*a* may be made of any suitable material, but the bottom layer 50*c* may be substantially thicker or thinner than 50*a*. While the core 50, as shown in FIG. 4, may be made of materials and from techniques that were previously known, the actual structure and/or configuration of the core 50 and specific ways of making or constructing the core 50 may differ from previously known surfboards.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

A board including a first end and a second end;

a contact section having a first end and an opposing second end;

wherein the contact section sits on a substantially level water surface when the apparatus is at rest on top of the substantially level water surface;

a first step section located adjacent the first end of the contact section;

wherein the first step section includes a first portion and a second portion;

wherein the first portion of the first step section is located adjacent the first end of the contact section and includes a first end and an opposing second end;

wherein the first end of the first portion of the first step section is joined to the first end of the contact section;

wherein the second end of the first portion of the first step section is joined to the second portion of the first step section;

wherein the second portion of the first step section is at a different height from the contact section so that it does not make contact with the substantially level water surface when the apparatus is at rest on the top of the substantially level water surface;

a first hydrofoil fixed to the first step section;

wherein the first hydrofoil is fixed to the second portion of the first step section;

wherein the first hydrofoil protrudes from the second portion of the first step section wherein the first hydrofoil does not make contact with the substantially level water surface when the apparatus is at rest on the top of the substantially level water surface;

wherein the first hydrofoil pierces the substantially level water surface and becomes submerged beneath the substantially level water surface when engaged;

wherein the first hydrofoil includes a keel and the first hydrofoil is fixed to the second portion of the first step section so that the keel is substantially perpendicular to the board; and wherein the first hydrofoil includes a wing which is fixed to and substantially perpendicular to the keel of the first hydrofoil;

wherein the first hydrofoil has a first end and an opposing second end;

wherein the first end of the first hydrofoil is located closer to the contact section than the opposing second end of the first hydrofoil;

wherein the wing of the first hydrofoil has an angle relative to the second portion of the first step section from zero degrees to less than ninety degrees, so that when the angle of the wing of the first hydrofoil relative to the second portion of the step section is greater than zero degrees, the wing of the first hydrofoil is inclined relative to the second portion of the step section from the first end of the first hydrofoil to the second end of the first hydrofoil; and wherein the wing of the first hydrofoil is inclined with respect to the second portion of the first step section, so that the shortest distance between the second end of the wing of the first hydrofoil and the second portion of the first step section is less than or equal to the shortest distance between the first end of the wing of the first hydrofoil and the second portion of the first step section.

2. The apparatus of claim 1 wherein the wing of the hydrofoil is configured so that a combination of fluid flow over a top of the wing and fluid flow under an opposing bottom of the wing generates a downward lift.

3. The apparatus of claim 1 wherein the first portion of the first step section includes a slanted surface.

4. The apparatus of claim 1 wherein the first portion of the first step section includes a sloped surface.

5. The apparatus of claim 1 wherein
the first portion of the first step section is a vertical plane, which is substantially perpendicular to the contact section of the board.

6. The apparatus of claim 1 wherein
the second portion of the first step section includes a slanted surface.

7. The apparatus of claim 1 wherein
the second portion of the first step section includes a sloped surface.

8. The apparatus of claim 1 wherein
the second portion of the first step section is a horizontal plane, which is substantially parallel to the substantially level water surface when the apparatus is at rest on the top of the substantially level water surface.

9. The apparatus of claim 1 wherein
the first portion of the first step section and the second portion of the first step section are one continuous slope.

10. The apparatus of claim 1 wherein
the first portion of the first step section and the adjacent end of the contact section are one continuous slope.

11. The apparatus of claim 1 wherein
the contact section is a horizontal plane.

12. The apparatus of claim 1 wherein
the contact section includes a slanted surface.

13. The apparatus of claim 1 wherein
the contact section includes a sloped surface.

14. The apparatus of claim 1 wherein
the board further includes:
a second step section;
wherein the second step section includes a first portion and a second portion;
wherein the first portion of the second step section is located adjacent the second end of the contact section and includes a first end and an opposing second end;
wherein the first end of the first portion of the second step section is joined to the second end of the contact section;
wherein the second end of the first portion of the second step section is joined to the second portion of the second step section;
wherein the second portion of the second step section is at a different height from the contact section so that it does not make contact with the substantially level water surface when the apparatus is at rest on the top of the substantially level water surface;
a second hydrofoil fixed to the second step section;
wherein the second hydrofoil is fixed to the second portion of the second step section;
wherein the second hydrofoil protrudes from the second portion of the second step section;
wherein the second hydrofoil does not make contact with the substantially level water surface when the apparatus is at rest on the top of the substantially level water surface;
wherein the second hydrofoil pierces the substantially level water surface and becomes submerged beneath the substantially level water surface when engaged;
wherein the second hydrofoil includes a keel and the second hydrofoil is fixed to the second portion of the second step section so that the keel is substantially perpendicular to the board; and
wherein the second hydrofoil includes a wing which is fixed to and substantially perpendicular to the keel of the second hydrofoil;
wherein the second hydrofoil has a first end and an opposing second end;
wherein the first end of the second hydrofoil is located closer to the contact section than the opposing second end of the second hydrofoil;
wherein the wing of the second hydrofoil has an angle relative to the second portion of the second step section from zero degrees to less than ninety degrees, so that when the angle of the wing of the second hydrofoil relative to the second portion of the second step section is greater than zero degrees, the wing of the second hydrofoil is inclined relative to the second portion of the second step section from the first end of the second hydrofoil to the second end of the second hydrofoil; and
wherein the wing of the second hydrofoil is inclined with respect to the second portion of the second step section, so that the shortest distance between the second end of the wing of the second hydrofoil and the second portion of the second step section is less than or equal to the shortest distance between the first end of the wing of the second hydrofoil and the second portion of the second step section.

15. The apparatus of claim 13 wherein
the board further includes:
a first contact extension fixed to the first step section;
a second hydrofoil fixed to the second portion of the first step section; and
wherein the first hydrofoil is fixed to the second portion of the first step section on one side of the first contact extension and the second hydrofoil is fixed to the second portion of the first step section on an opposing side of the first contact extension.

16. The apparatus of claim 13 wherein
the board further includes:
a first contact extension fixed to the first step section;
a second contact extension fixed to the second step section;
a third hydrofoil fixed to the second portion of the first step section;
a fourth hydrofoil fixed to the second portion of the second step section; and
wherein the first hydrofoil is fixed to the second portion of the first step section on one side of the first contact extension and the third hydrofoil is fixed to the second portion of the first step section on an opposing side of the first contact extension;
wherein the second hydrofoil is fixed to the second portion of the second step section on one side of the second contact extension and the fourth hydrofoil is fixed to the second portion of the second step section on an opposing side of the second contact extension.

17. The apparatus of claim 13 wherein
the board further includes:
a first horizontal stringer.

18. A method comprising
placing a board on a water surface, so that a bottom surface of a contact section of the board is on the water surface;
having an individual place at least part of the individual's body on a top surface of the board, while the board is on the water surface;
having the individual travel on the water surface while at least part of the individual's body is on the top surface of the board;
wherein the board includes:
a first end and a second end;
the contact section having a first end and an opposing second end;

wherein the contact section sits on the water surface when the apparatus is at rest on top of the water surface, and when the water surface is substantially level;

a first step section located adjacent the first end of the contact section;

wherein the first step section includes a first portion and a second portion;

wherein the first portion of the first step section is located adjacent the first end of the contact section and includes a first end and an opposing second end;

wherein the first end of the first portion of the first step section is joined to the first end of the contact section;

wherein the second end of the first portion of the first step section is joined to the second portion of the first step section;

wherein the second portion of the first step section is at a different height from the contact section so that it does not make contact with the water surface when the apparatus is at rest on the top of the water surface, and when the water surface is substantially level;

a first hydrofoil fixed to the first step section;

wherein the first hydrofoil is fixed to the second portion of the first step section;

wherein the first hydrofoil protrudes from the second portion of the first step section wherein the first hydrofoil does not make contact with the water surface when the apparatus is at rest on the top of the water surface and when the water surface is substantially level;

wherein the first hydrofoil pierces the water surface and becomes submerged beneath the water surface when engaged;

wherein the first hydrofoil includes a keel and the first hydrofoil is fixed to the second portion of the first step section so that the keel is substantially perpendicular to the board; and wherein the first hydrofoil includes a wing which is fixed to and substantially perpendicular to the keel of the first hydrofoil;

wherein the first hydrofoil has a first end and an opposing second end;

wherein the first end of the first hydrofoil is located closer to the contact section than the opposing second end of the first hydrofoil;

wherein the wing of the first hydrofoil has an angle relative to the second portion of the first step section from zero degrees to less than ninety degrees, so that when the angle of the wing of the first hydrofoil relative to the second portion of the step section is greater than zero degrees, the wing of the first hydrofoil is inclined relative to the second portion of the step section from the first end of the first hydrofoil to the second end of the first hydrofoil; and wherein the wing of the first hydrofoil is inclined with respect to the second portion of the first step section, so that the shortest distance between the second end of the wing of the first hydrofoil and the second portion of the first step section is less than or equal to the shortest distance between the first end of the wing of the first hydrofoil and the second portion of the first step section.

* * * * *